US007252798B2

(12) United States Patent
Ebner et al.

(10) Patent No.: US 7,252,798 B2
(45) Date of Patent: Aug. 7, 2007

(54) HOOD-TYPE ANNEALING FURNACE, ESPECIALLY FOR STEEL STRIP AND WIRE BUNCHES

(75) Inventors: Peter Ebner, Leonding (AT); Heribert Lochner, Leonding (AT)

(73) Assignee: Ebner Industrieofenbau Gesellschaft m.b.H., Leonding (AT)

( * ) Notice: Subject to any disclaimer, the term of this patent is extended or adjusted under 35 U.S.C. 154(b) by 300 days.

(21) Appl. No.: 10/806,773

(22) Filed: Mar. 23, 2004

(65) Prior Publication Data

US 2004/0217527 A1 Nov. 4, 2004

(30) Foreign Application Priority Data

Mar. 24, 2003 (AT) ..... A 461/2003

(51) Int. Cl.
*C21D 1/06* (2006.01)

(52) U.S. Cl. ..... 266/256; 266/262; 266/263

(58) Field of Classification Search ..... 266/263, 266/252, 249, 262, 256
See application file for complete search history.

(56) References Cited

U.S. PATENT DOCUMENTS 3,071,500 A * 1/1963 Corbett et al. ..... 266/256
5,730,930 A * 3/1998 Velten et al. ..... 266/252

FOREIGN PATENT DOCUMENTS

DE 2228215 7/1973
JP 409235619 A * 9/1997

OTHER PUBLICATIONS

English Language Translation of JP409235619A, Sep. 1997.*

* cited by examiner

*Primary Examiner*—Scott Kastler
(74) *Attorney, Agent, or Firm*—Collard & Roe, P.C.

(57) ABSTRACT

The invention describes a hood-type annealing furnace, especially for steel strip or wire bunches, with an annealing base (1) for receiving the material (7) to be annealed, a protective hood (8) which is placed on the furnace in a gas-tight manner, a radial blower (2) which is held in the annealing base (1) and comprises a blade wheel (3) and a guide apparatus (5) enclosing the blade wheel (3) for circulating a protective gas in the protective hood (8), a heat exchanger (11) for cooling the protective gas, which heat exchanger (11) is connected on the input side via a flow conduit (13) with the pressure side of the radial blower (2) and opens on the output side in an annular gap (12) between the guide apparatus (5) and the protective hood (8), and a deflection device which is axially displaceable into the pressure-side flow path of the radial blower (2) for the optional connection to the radial blower (2) of the flow conduit (13) which leads to the heat exchanger (11). In order to provide simple construction conditions it is proposed that the protective hood (8) is held in a gas-tight manner via an annular flange (9), that the heat exchanger (11) is disposed below the annular flange (9), that the flow conduit (13) consists of an annular conduit (14) starting from the outer circumference of the guide apparatus (5) and being concentric to the annular gap (12), and that the deflection device is arranged as an annular deflection slide (18) which encloses the guide apparatus (5) on the outside.

3 Claims, 2 Drawing Sheets

HOOD-TYPE ANNEALING FURNACE, ESPECIALLY FOR STEEL STRIP AND WIRE BUNCHES

FIELD OF THE INVENTION

The invention relates to a hood-type annealing furnace, especially for steel strip or wire bunches, with an annealing base for receiving the material to be annealed, a protective hood which is placed on the furnace in a gas-tight manner, a radial blower held in the annealing base comprising a blade wheel and a guide apparatus enclosing the blade wheel for circulating a protective gas in the protective hood, a heat exchanger for cooling the protective gas, which heat exchanger is connected on the input side via a flow conduit with the pressure side of the radial blower and opens on the output side in an annular gap between the guide apparatus and the protective hood, and a deflection device which is axially displaceable into the pressure-side flow path of the radial blower for the optional connection to the radial blower of the flow conduit which leads to the heat exchanger.

DESCRIPTION OF THE PRIOR ART

In the thermal treatment of metallic material to be annealed such as steel strip or wire bunches, the thermal treatment as well as the necessary subsequent cooling occur under protective furnace gas, which is mostly nitrogen or hydrogen or a mixture of said gases. For the purpose of cooling the material to be annealed, the protective furnace gas which is withdrawn from the protective hood via a central radial blower is guided for cooling purposes over a heat exchanger before it flows into the protective hood again. For this purpose it is known (DE 2 228 215 A) to provide an annular cooling chamber with cooling spirals beneath the annealing base receiving the material to be annealed to connect this cooling chamber via axial flow conduits with the pressure side of the radial blower; namely between the blade wheel and the guide apparatus of said radial blower. Axially adjustable slides are held in the flow conduits which can be pushed forward into the pressure-side flow path of the radial blower in order to guide the gas stream removed from the protective hood over the cooling chamber which is in flow connection with the protective hood via an outer annular gap between the guide apparatus of the radial blower and the protective hood. The flow conduits are closed off in the lowered position of the slide, so that the protective gas which is axially drawn in is guided via the blade wheel of the radial blower through the guide apparatus in the circulation into the protective hood. The slides are lifted for the purpose of cooling the protective gas, which leads to the deflection of the protective gas downwardly to the cooling chamber. Since the annealing base needs to be broken through downwardly, the arrangement of the axial flow conduits has a disadvantageous effect on the carrying capability of the annealing base. Moreover, unfavorable flow conditions are obtained in the deflection of the protective gas to the cooling chamber because the changeover device needs to be provided in the region of the highest outlet speed of the protective gas from the blade wheel.

SUMMARY OF THE INVENTION

The invention is thus based on the object of providing a hood-type annealing furnace of the kind mentioned above with simple constructional means in such a way that an advantageous protective gas cooling can be achieved without having to permanently intervene in the construction of the annealing furnace.

This object is achieved in accordance with the invention in such a way that the protective hood is held in a gas-tight manner via an annular flange, that the heat exchanger is disposed below the annular flange, that the flow conduit consists of an annular conduit starting from the outer circumference of the guide apparatus and being concentric to the annular gap and that the deflection device is arranged as an annular deflection slide which encloses the guide apparatus on the outside.

As a result of moving the flow conduit to the outer circumferential region of the annealing base, the same can be arranged in a substantially unchanged way. An additional aspect is that the deflection device which deflects the protective gas to be cooled to the annular conduit leading to the heat exchanger is assigned to the outlet side of the guide apparatus, which allows advantageous flow conditions for the gas flow to be deflected, since the deflection slide encloses the guide apparatus consistently. The flow conduit which starts out from the outer circumference of the guide apparatus and is arranged as an annular conduit also constitutes an advantageous precondition for a heat exchanger arrangement in the form of a ring enclosing the annealing base, which allows for a simpler sealing of the protective hood via an annular flange without having to implement special cooling measures in this region. The heat exchanger situated below the annular flange of the protective hood ensures a respective cooling in this region via the cooled protective gas.

In order to obtain especially simple constructional conditions, the annular conduit and the annular gap can be separated by a cylindrical wall from each other which is held in an axially displaceable way and carries the annular deflection slide. Since the cylindrical wall is used for adjusting the annular deflection slide, the otherwise required drive connections between the actuating drive and the deflection slide can be omitted.

If the guide blades of the guide apparatus are provided on their outer face sides with recesses for the deflection slide, then this will lead to a compact design in the radial direction, allowing for a direct takeover of the flow guidance by the deflection slide, namely in the case of a respective configuration of the deflection slide both towards the protective hood as well as towards the annular conduit.

BRIEF DESCRIPTION OF THE DRAWINGS

The subject matter of the invention is shown in the drawings by way of example, wherein.

DESCRIPTION OF THE PREFERRED EMBODIMENTS

Figure 1:
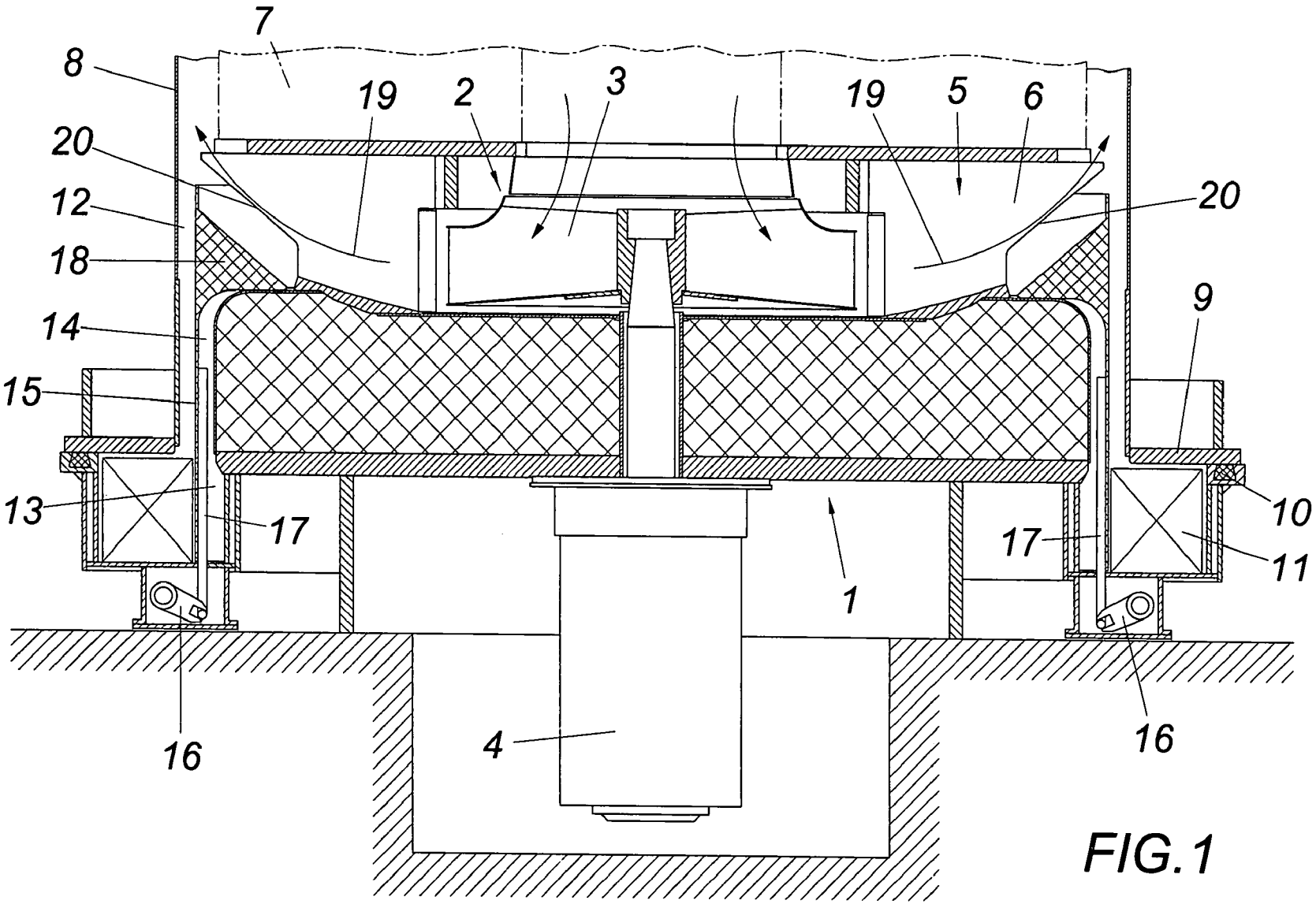
FIG. 1 shows a hood-type annealing furnace in accordance with the invention in sections in the region of the annealing base in a schematic axial sectional view and FIG. 2 shows said annealing furnace in the region of the heat exchanger also in an axial sectional view, but on a larger scale.

The hood-type annealing furnace according to the illustrated embodiment shows an annealing base 1 in which a radial blower 2 is held whose blade wheel 3 is driven by a motor 4. The blade wheel 3 is enclosed by a guide apparatus 5 whose guide blades are designated with reference numeral 6. The material 7 which is to be annealed, is situated on the annealing base 1 and is indicated merely with the dot-dash line, is covered by a protective hood 8 which is supported through an annular flange 9 which ensures a gas-tight occlusion of the protective hood 8 via a circular gasket 10.

Below the annular flange 9 of the protective hood 8, the annealing base 1 is enclosed by a heat exchanger 11 which on the outflow side opens into an annular gap 12 between the protective hood 8 and the guide apparatus 5. On the inflow side, the heat exchanger 11 is adjacently connected to a flow conduit 13 which is arranged as an annular conduit 14 which is concentric to the annular gap 12. The separation between the annular conduit 14 and the annular gap 12 is performed by a cylindrical wall 15 which is held in an axially displaceable manner and is connected with an actuating drive 16 via lifting rods 17. The wall 15 carries a deflection device which is adjacent on the outside to the guide apparatus 5 and is in the form of an annular deflection slide 18 which encloses the guide apparatus 5 and either releases the gas flow according to FIG. 1 into the protective hood 8 (as is indicated by the flow arrow 19) or deflects the gas flow according to FIG. 2 into the annular conduit 14. As a result of the wedge-like cross section of the deflection slide 18 the same can also be used in intermediate positions, which allows a temperature control of the protective gas in the protective hood 8.

Since the guide blades 6 of the guide apparatus 5 are provided with recesses 20 which are adjusted on the outer face side to the cross-sectional shape of the deflection slide 18, the deflection slide fits advantageously into the gained space, which entails a radially compact design.

Figure 2:
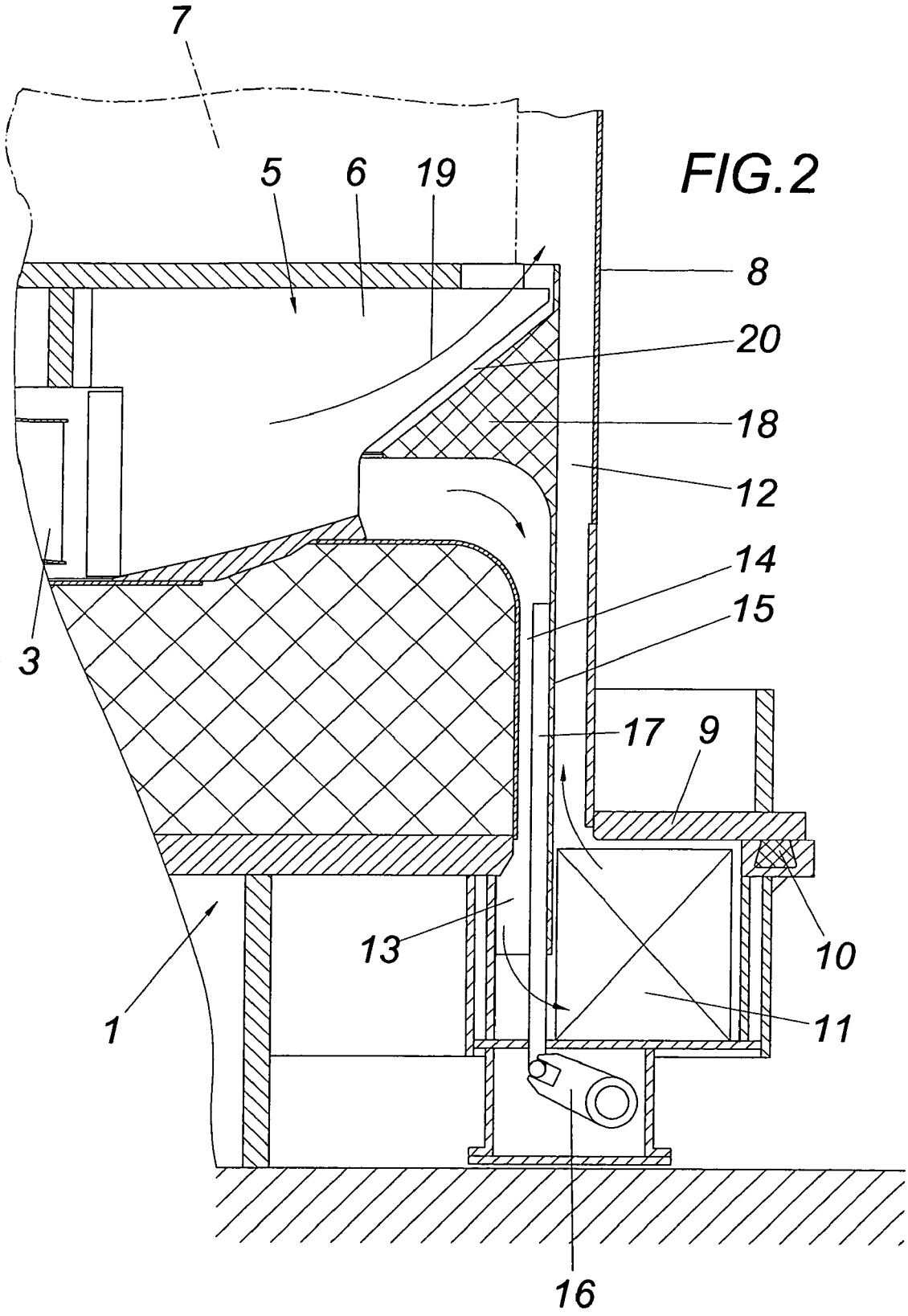

For the purpose of cooling the protective gas in the protective hood 8, the deflection slide 18 is lifted from the lowered position as shown in FIG. 1 to the position according to FIG. 2 in order to cool a respective gas stream via the annular conduit 14 by the heat exchanger 11 and to supply the same again to the protective hood 8 via the annular gap 12. The cooling of the protective gas in the region below the annular flange 9 entails a cooling of the protective hood with the annular flange 9 in this region, which allows omitting separate cooling measures which would otherwise be necessary.

The invention claimed is:

1. A hood-type annealing furnace, especially for steel strip or wire bunches, with an annealing base for receiving the material to be annealed, a protective hood which is placed on the furnace in a gas-tight manner, a radial blower which is held in the annealing base and comprises a blade wheel and a guide apparatus enclosing the blade wheel for circulating a protective gas in the protective hood, a heat exchanger for cooling the protective gas, which heat exchanger is connected on an input side via a flow conduit with a pressure side of the radial blower and opens on an output side in an annular gap between the guide apparatus and the protective hood, and a deflection device which is axially displaceable into the pressure-side flow path of the radial blower for optional connection to the radial blower of the flow conduit which leads to the heat exchanger, wherein the protective hood is held in a gas-tight manner via an annular flange, the heat exchanger is disposed directly beneath the annular flange, the flow conduit consists of an annular conduit starting from an outer circumference of the guide apparatus and being concentric to the annular gap, and the deflection device is an annular deflection slide which encloses the guide apparatus on the outside.

2. A hood-type annealing furnace as claimed in claim 1, wherein the annular conduit and the annular gap are separated from each other by a cylindrical wall which is held in an axially displaceable way and carries the annular deflection slide.

3. A hood-type annealing furnace as claimed in claim 1, wherein guide blades of the guide apparatus have recesses for the deflection slide on an outer face side of the guide blades.

* * * * *